US009120993B2

(12) United States Patent
Linden

(10) Patent No.: US 9,120,993 B2
(45) Date of Patent: Sep. 1, 2015

(54) LUBRICATING PELLET

(76) Inventor: Rick Richard Linden, Westerville, OH (US)

( * ) Notice: Subject to any disclaimer, the term of this patent is extended or adjusted under 35 U.S.C. 154(b) by 662 days.

(21) Appl. No.: 13/344,780

(22) Filed: Jan. 6, 2012

(65) Prior Publication Data

US 2013/0178401 A1 Jul. 11, 2013

(51) Int. Cl.
*C10M 169/04* (2006.01)
*C10M 171/06* (2006.01)

(52) U.S. Cl.
CPC ..... *C10M 171/06* (2013.01); *C10N 2240/202* (2013.01); *C10N 2250/16* (2013.01)

(58) Field of Classification Search
CPC ..... C10N 2220/022; C10N 2240/10
USPC ..... 508/110
See application file for complete search history.

(56) References Cited

U.S. PATENT DOCUMENTS

| | | | | |
|---|---|---|---|---|
| 3,950,047 | A | 4/1976 | Capelli | |
| 7,905,181 | B2 | 3/2011 | Ciesiun | |
| 2011/0218129 | A1 * | 9/2011 | Schroeck et al. | 508/268 |
| 2012/0129742 | A1 * | 5/2012 | Matray et al. | 508/156 |

* cited by examiner

*Primary Examiner* — Vishal Vasisth
(74) *Attorney, Agent, or Firm* — Neal T. Hauschild

(57) ABSTRACT

A method of lubricating an electrical apparatus by projecting a lubricating pellet which includes an impact-rupturable shell defining an interior cavity, a lubricating substance consisting of grease or oil or other lubricating substance disposed throughout the interior cavity and contained within by said shell, providing a impact-rupturable container when the lubricating pellet is ejected from a pellet discharge device, hitting an intended target and disbursing the lubricating substance onto the target.

12 Claims, 4 Drawing Sheets

LUBRICATING PELLET

CROSS REFERENCE TO RELATED APPLICATION

Not Applicable

STATEMENT REGARDING FEDERALLY SPONSORED RESEARCH OR DEVELOPMENT

Not Applicable

REFERENCE TO SEQUENCE LISTING

Not Applicable

BACKGROUND OF THE INVENTION

Lubricants are critical in getting electrical switches to meet their life and operating specifications. Choosing the right one requires a full understanding of the switch and its environment. Lubricants improve switch performance in three ways. Primarily, they prevent environmental and galvanic corrosion on switch contacts. Airborne contaminants attack metals, causing oxides to gradually build up in pores until they reach the surface, where they impede current flow. Non-noble contact surfaces and switches made of dissimilar metals are especially susceptible to moisture, oxygen, and aggressive gases. Even noble-metal plating is at risk if it's worn or porous.

Lubricants also minimize wear, especially on sliding electrical contacts which see repetitive cycling or arc damage, two common causes of failures. Though evidence suggests lubricants change or reduce arc patterns, the lubricant's real job on sliding contacts is to separate the surfaces during operation and keep debris out of the contact area. Otherwise, the microscopic wear particles oxidize quickly, turning into insulators. Buildup of this oxide grit also accelerates wear. In general, hydrocarbon lubricants work best at wear prevention because their molecular structure is more rigid than other base oils. Proper lubricants strike a balance between preventing wear and maintaining electrical continuity.

And finally, lubricants reduce the friction between switch components, thus reducing the amount of force needed to activate a switch. Lubricants usually ensure a coefficient of friction of 0.1 or less, which means it takes little force to operate a device with a high preload. This can be important in switches where high normal forces ensure low contact resistance and a stable signal or power path. Lubrication is also mechanically important because it gives the end user smooth, uniform operation.

Damping greases (high-viscosity lubricants) are used to provide drag and give switches a "high-quality" feel. Although silicones historically have been used as damping greases, new high-molecular weight polymers offer a similar feel without fear of silicone migration, which is more than an aesthetic problem. Under arcing, silicone degrades to silicon dioxide (sand), an abrasive and insulating by-product that destroys contacts quickly.

Safety when working around high voltage switches is a major concern. Having to manually apply lubrication to transformers and high voltage electrical switches poses a safety and health risk, but it is necessary to lubricate because high current levels also raise the issue of arcing. Under an arc, temperatures can reach 1,000 C. At that temperature, most metals become molten and most hydrocarbons polymerize, becoming a tacky, viscous, insulating film that is not easily displaced. No material can withstand this abuse, and eventually the switch fails, causing an open circuit. To prevent arcing, choose a lubricant with the longest life under such conditions. In theory, lubricants that vaporize instead of polymerize—such as polyglycols and PFPEs—work better because they leave no insulating residue. However, as a lubricant vaporizes, less remains to lubricate.

The ability to apply a lubricating substance from a safe distance from the apparatus is ideal.

The impact-rupturable pellet containing the lubricating substance as described in this invention are set into projectile motion with the shell substantially intact at a velocity sufficient to create the force permitting rupture of the shell and release of the liquid dye composition therein upon physical impact with the target surface. Typically, the suitable velocity range is from about 200 ft/sec to about 400 ft/sec, preferably within a range from about 300 ft/sec to about 350 ft/sec. Such devices are typically in the form of a gun assembly adapted for use with the pellet. The gun assembly is commonly referred to as a lubricating pellet gun or "marker." Suitable lubricating pellet guns include commercially available models such as those from Brass Eagle (Bentonville, Ark.). Accordingly in use, the impact-rupturable capsule is removed from a container and loaded into the lubricating pellet gun. The gun is aimed at the intended target and fired, ejecting the impact-rupturable capsule substantially intact at high speed toward the target through the use of pressurized CO.sub.2 or N.sub.2. Upon impact on the target surface, the shell ruptures thereby releasing the liquid contents within onto the surface.

SUMMARY OF THE INVENTION

The present invention makes it possible to safely apply a lubricating substance on a target which is normally difficult to get access to or poses a health or safety risk for manual application of the lubricating substance. With the present invention, a nonsolid lubricant such as oil or grease is encapsulated in frangible or impact-rupturable pellet. Since an air gun or other pneumatic device may be used, a standard, 0.68 inch diameter is the preferred size of the pellet, but sizes can vary depending on the size of the target and the pellet delivery system used.

The body of the pellet, or shell is frangible and/or biodegradable. The engagement of pressure or force on the pellet causes the shell to break and frees the nonsolid lubricant from the broken pellet and such freed lubricant lubricates the target surface. Although encapsulation is particularly adapted for nonsolid lubricants, it can be used for any lubricant, the release or exposure of which should be delayed until impact.

As this invention makes it possible to employ nonsolid lubricants in pellet of this type, the environmental shortcomings of dry lubricants are no longer a limiting factor to the extent that nonsolid lubricants, which overcome these shortcomings, are available.

The dry lubricant would perform a lubricating function in the middle temperature range but would be substantially inoperative as a lubricant in the low temperature range.

Yet another object of the present invention is to provide pellets that are fabricated from water-based instead of an oil-based material. A feature of the water based pellets is a soluble polymer shell. Another feature of the water based pellets is an insoluble coating on an inner wall of the shell. An advantage of the water based pellets is that the shell biodegrades relatively fast. Another advantage of the water based pellets is that the shell will not degrade or dissolve when a water based or lubricating material is disposed within a cavity defined by the shell, due to the lubricating material engaging only the insoluble coating. Another object of the present invention is to provide water based pellets that do not harm landscape exposed to pellet activity. An advantage of the water based pellets is that the ph level of the lubricating material is substantially equal to the ph level of water (i.e. 7.0). Another advantage of the water based pellets is that the lubricating material biodegrades relatively fast.

Another object of the present invention is to provide water based pellets that are relatively easy and inexpensive to fabricate. Another advantage of the water based pellet is that when the pellet is forcibly urged toward a target, the lubricating material is in an active liquid state that promotes the dispersing of the lubricating material (and pigments suspended in the lubricating material) upon a target surface.

The invention further provides a method for fabricating pellets, said method comprising the steps of fabricating a plurality of relatively rigid spheres of lubricating fill material; coating, dipping or spraying said lubricating material spheres with an insoluble material; and forming a shell about said coated lubricating spheres, whereby a spherical pellet is fabricated that ultimately engages a target, whereupon, said shell ruptures thereby promoting the engagement of a now substantially liquid lubricating material upon the target.

Soluble outer shell materials, such as gelatin, may be used.

BRIEF DESCRIPTION OF THE DRAWINGS

These and other objects, advantages and novel features of the present invention, as well as details of an illustrative embodiment thereof, will be more fully understood from the following detailed description and attached drawings, wherein.

DESCRIPTION OF THE PREFERRED EMBODIMENT

Figure 1:
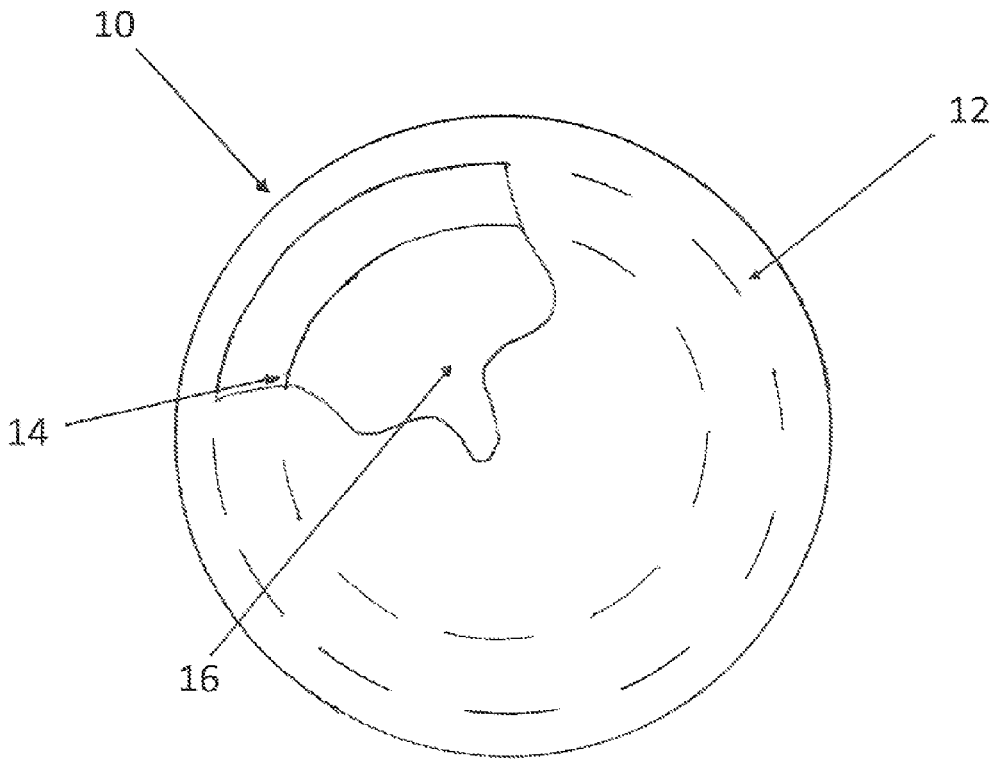
FIG. 1 is a front elevation, partial phantom-partial cutaway view of a seamless lubricating pellet having a lubricating substance in an inner cavity in accordance with the present invention.

Referring to FIG. 1, a water-based lubricating pellet in accordance with the present invention is depicted and denoted as numeral 10. The lubricating pellet 10 includes a shell 12 of soluble materials (usually gelatin) defining an interior cavity 14, and a lubricating material 16 disposed and disbursed within the cavity 14 such that when the lubricating pellet 10 is forcibly ejected from a lubricating pellet gun (not depicted) ultimately engaging a target causing the shell 12 to rupture and the lubricating substance 16 to disburse upon the target surface.

The outer shell 12 may be comprised of soluble such as gelatin or insoluble materials such as plastics, waxes and hardeners such as carnauba, candelilla, bees, paraffin, stearic acid, synthetic polymers, polyesters, polylactic acid, starch copolymers, high molecular weight polyvinylalcohol, unstabalized polyethelyne, unstabilized polypropylene, polystyrene, and combinations thereof. In this embodiment it is intended that when the pellet is projected at sufficient force that the shell 12 fractures and expels the lubricating substance 16.

The shell 12 is fabricated from a gelatin cast into a rolled sheet, or an extrusion grade biodegradable polymer, extrusion-compounded with inert processing aids and pigments, and extrusion cast into a rolled sheet of dimensions well known to those of ordinary skill in the art. Suitable polymers include, but are not limited to biodegradable polyesters, polylactic acid, starch copolymers and polymer blends, high molecular weight polyvinylalcohol, unstabilized polyethylene, unstabilized polypropylene and polystyrene, and combinations thereof. Coloring pigments may be included in the shell 12.

An alternative method for fabricating the lubricating pellets 10 includes two congruent sets of molds with selected configurations (usually spherical). The molds are joined together to form an interior cavity 14 to allow the lubricating substance 16 to be suspended within the shell 12. The lubricating pellet 10 can be ejected or projected from an air powered gun or other transmittal device. The shell 12 is capable of breaking or rupturing upon a target, whereupon, the rupturing of the shell 12 releases the lubricating substance 16 upon the target.

Figure 2:
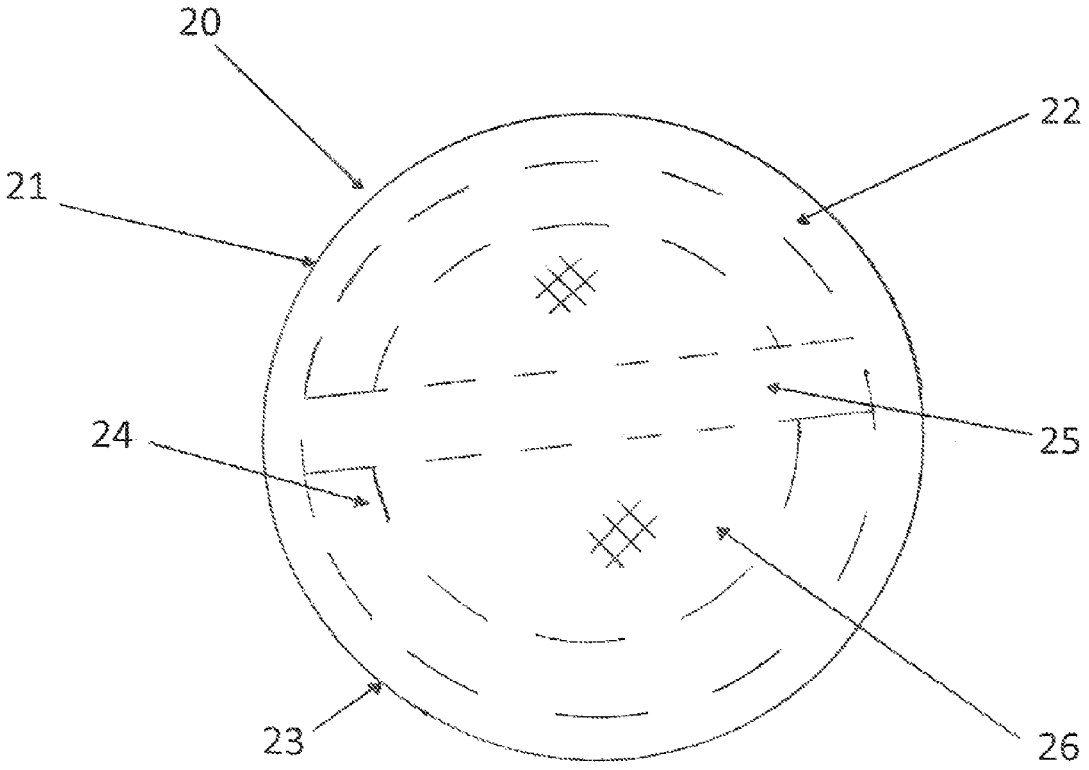
FIG. 2 is a front elevation, partial phantom-partial cutaway view of the lubricating pellet of FIG. 1 but with a seam (fusing line) from where the two hemispheres are connected to form the inner cavity in accordance with the present invention.

Referring now to FIG. 2, an alternative embodiment 20 in accordance with the present invention is depicted. The alternative embodiment 20 includes an impact-rupturable solid spherical outer shell 22 formed from two hemispheres, right hemisphere 21 and left hemisphere 23, fused together at fusing line 25 to define the inner cavity 24 containing a lubricating substance 26.

The lubricating pellet 20 is manufactured by first feeding a polymer sheet material onto a heated, horizontal vacuum thermoforming mold. The thermo forming molds contain multiple cavities, in the shape of lubricating pellet half-shells. Any caliber of lubricating pellets may be manufactured by adjusting the thermoforming mold cavity geometries to the desired dimensions. By using heated vacuum molds and plug assistance, to ensure uniform shell wall thickness, webs of lubricating pellet hemispheres are thermoformed. The hemisphere cavities are then filled with the lubricating material 26 using precision metering nozzles so that the right hemisphere 21 and the left hemisphere 23 is completely filled, level with the top of the hemisphere. The filling rate and shear of the nozzle is chosen so that the lubricating material 26 thins enough during injection to self-level in the interior cavity 24 of the hemispheres. The two filled hemispheres are then turned, either horizontal or vertical, so that the right hemisphere 21 and left hemisphere 23 oppose each other and the half-shells are then quickly brought together and compressed with a fusing line 25, thus fusing the two filled hemispheres together and forming the lubricating pellet 20.

Other methods of fusing the hemispheres for sealing may be used such as heated molds and ultrasonic welding. Alternatively, the lubricating pellet hemispheres or half-shells may be fused using any suitable adhesive material or fusing methods such as radio frequency sealing along the fusing line.

Figure 3:
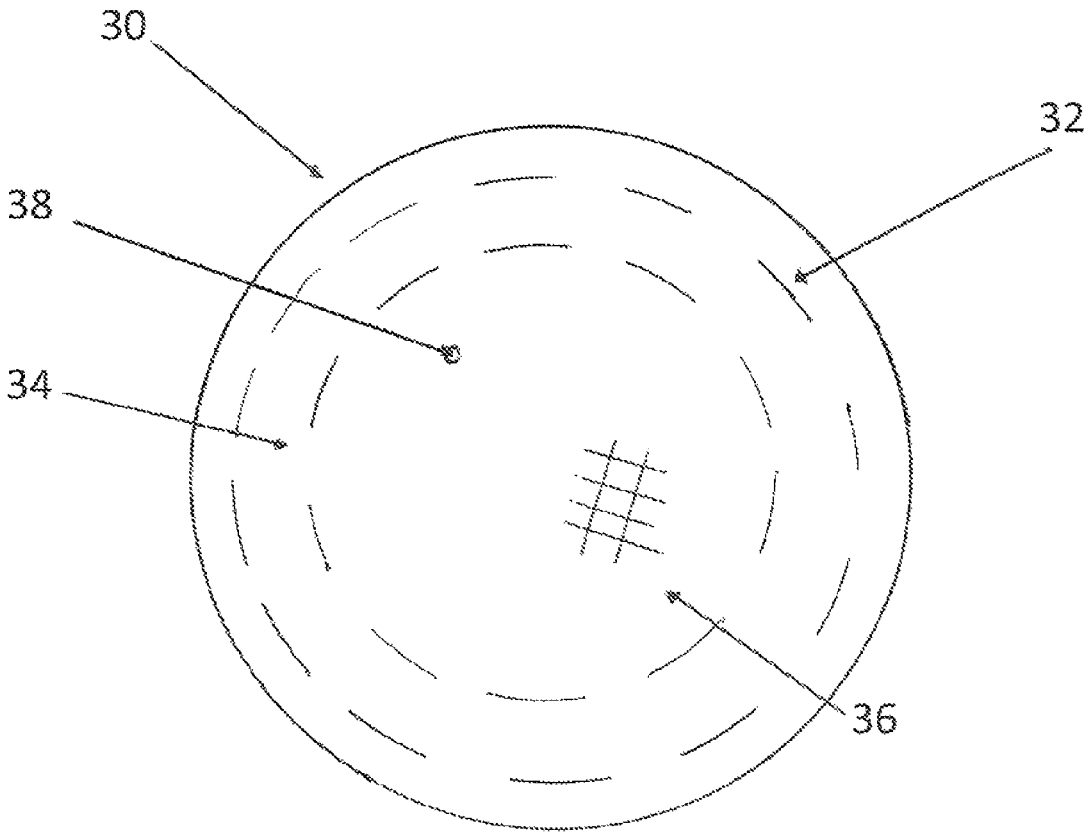
FIG. 3 is a front elevation, partial phantom-partial cutaway view of a lubricating pellet having an injection or disposition point in which the inner cavity is filled with the lubricating substance in accordance with the present invention.

Referring now to FIG. 3, a third embodiment 30 in accordance with the present invention is depicted. The third embodiment includes a homogenous outer shell 32 that is penetrated at an injection or depiction point 38 at which the lubricating substance 36 is instilled into the inner cavity 34. The injection or depiction point is then sealed to prevent leakage of the lubricating substance. Any sealing method may be used, similar to the fusing methods discussed above, to seal said injection point The lubricating substance 36 disposed within the spherical shell 32 may include but is not limited to, polyethylene glycols, waxes, oils, and greases.

Figure 4:
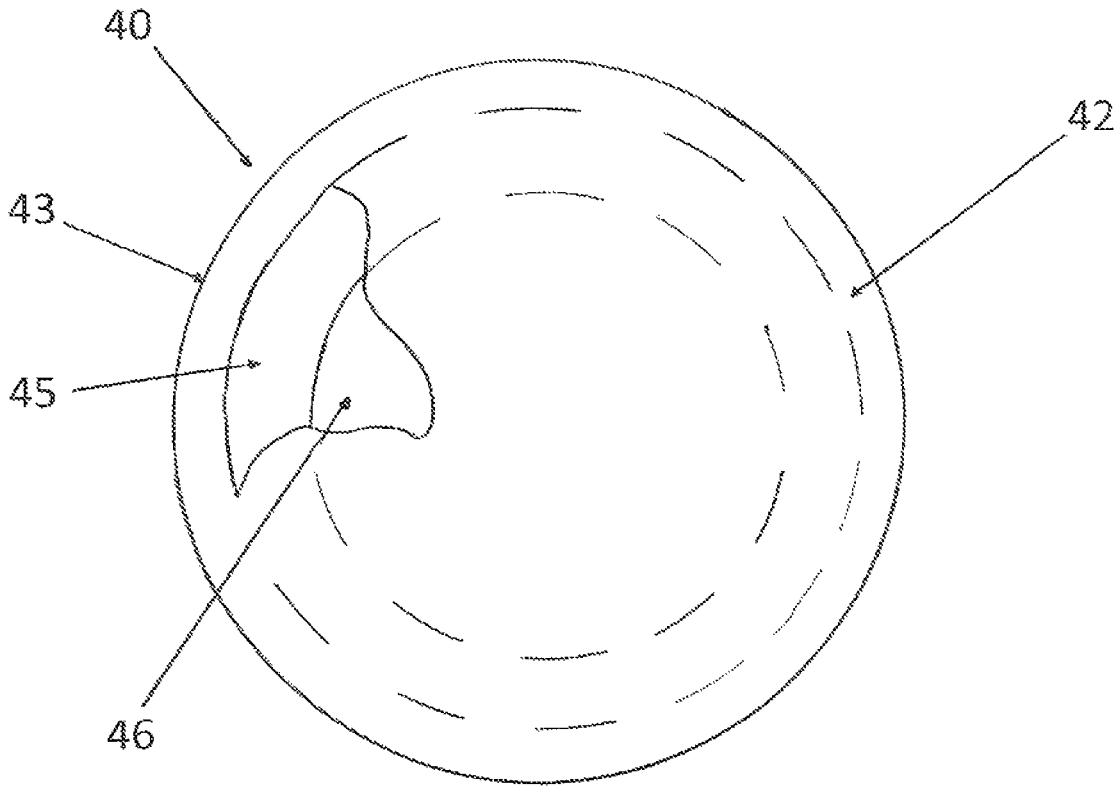
FIG. 4 is a front elevation, partial phantom-partial cutaway view of a lubricating pellet showing the thickness of the shell and outer surface of the pellet in which the inner cavity is filled with a lubricating substance.

Referring to FIG. 4, a fourth embodiment of the pellet 40 is depicted. The pellet 40 includes a shell 32 having a outer surface 43 that is of a uniform thickness 45 which encloses the lubricating substance 46.

The foregoing description is for purposes of illustration only and is not intended to limit the scope of protection accorded this invention. The scope of protection is to be measured by the claims, which should be interpreted as broadly as the inventive contribution permits.

Although exemplary embodiments of the invention have been shown and described, many changes, modifications and substitutions may be made by one having ordinary skill in the art without necessarily departing from the spirit and scope of this invention.

The invention claimed is:

1. A method of lubricating an electrical apparatus by projecting an impact-rupturable pellet comprising:

A shell adapted to contain a lubricating substance, to remain intact upon exertion of projectile forces sufficient to propel said shell, and to rupture upon impact with a solid or semi-solid surface and release said lubricating substance.

2. The method of claim 1 wherein said shell comprising: a central recessed right hemisphere; said lubricating substance disposed within said central recessed right hemisphere, completely filling and self-leveling said lubricating substance in said right hemisphere without engaging a fusing line of said right hemisphere to promote the bonding of said fusing line; a central recessed left hemisphere, said right hemisphere and said left hemisphere having the same dimensions and configurations, said left hemisphere being disposed relatively close to but separate from said right hemisphere; and said lubricating substance disposed within said central recessed left hemisphere, thereby completely filling and self-leveling said lubricating substance in said left hemisphere without engaging a fusing line of said left hemisphere to promote the bonding of said sealing surface, said left hemisphere ultimately being inverted and aligned over said right hemisphere without providing a barrier to seal said lubricating substance in said left hemisphere, whereby said left hemisphere is ultimately fused to said right hemisphere at said fusing line resulting in a pellet that ruptures when forcibly engaging a target to promote a release of said lubricating substance upon the target.

3. The method of claim 1 wherein said shell comprising: a spherical shape having an interior cavity; a lubricating substance that is disposed within said interior cavity of said spherical shell at a disposition site, completely filling said interior cavity whereby said spherical shell is ultimately sealed at said disposition site resulting in a pellet that ruptures when forcibly engaging a target to promote a release of said lubricating substance upon the target.

4. The method of claim 1 wherein said shell comprising: a fluid outer layer that is sprayed simultaneously with said lubricating substance; wherein said outer layer completely coats said lubricating substance, and thereupon drips into a cooling compound which solidifies said outer layer and forms said seamless pellet.

5. The method of claim 1 wherein said shell is biodegradable.

6. The method of claim 1 wherein said shell includes a pigment material to indicate what said lubricating substance is inside said shell.

7. The method of claim 1 wherein said lubricating substance is a lubricating oil.

8. The method of claim 1 wherein said lubricating substance is a lubricating grease.

9. The method in claim 1 wherein said lubricating substance is a composition of dry lubricant particles.

10. A method of lubricating an electrical apparatus by using an air gun to project a pellet comprising: a shell having a spherical outer surface; a lubricating substance within said shell; wherein a thickness of said shell is uniform over said entire outer surface thereof, which would rupture upon impact with said apparatus, dispersing said lubricating substance onto said apparatus.

11. The method of claim 10, wherein said outer surface defines an outer radius that is generally 0.68 inch in diameter.

12. The method of claim 10, wherein said shell is comprised of a gelatinous material.

* * * * *